United States Patent [19]

Jung et al.

[11] 3,939,765

[45] Feb. 24, 1976

[54] TRASH COMPACTOR

[75] Inventors: Anton Ladislaus Jung, Herborn; Manfred Lapczyna, Wetzlar; Peter Möws, Wetzlar; Gerhard Schmidt-Burbach, Wetzlar; Heinz Strauss, Lohnberg, all of Germany

[73] Assignee: Buderus'sche Eisenwerke, Wetzler, Germany

[22] Filed: Sept. 3, 1974

[21] Appl. No.: 502,798

[30] Foreign Application Priority Data

Sept. 3, 1973 Germany ..... 2344366

[52] U.S. Cl. ..... 100/100; 100/269 A

[51] Int. Cl.[2] ..... B30B 15/14

[58] Field of Search ..... 100/100, 269 A, 269 R, 100/278, 255, 215; 144/281 A; 425/DIG. 19; 30/180, 228; 92/36, 37, 39

[56] References Cited

UNITED STATES PATENTS

| | | | |
|---|---|---|---|
| 3,074,163 | 1/1963 | Wohler et al. | 30/288 X |
| 3,478,909 | 11/1969 | Charles | 100/269 A |
| 3,654,855 | 4/1972 | Longo | 100/269 A |
| 3,667,891 | 6/1972 | Gelin | 100/269 A |
| 3,680,475 | 8/1972 | Gladwin | 100/100 |
| 3,736,863 | 6/1973 | Brucker | 100/269 A |
| 3,809,269 | 5/1974 | Lundahl | 100/278 X |

FOREIGN PATENTS OR APPLICATIONS

| | | | |
|---|---|---|---|
| 340,575 | 5/1904 | France | 100/255 |

*Primary Examiner*—Billy J. Wilhite
*Attorney, Agent, or Firm*—Karl F. Ross; Herbert Dubno

[57] ABSTRACT

A trash compactor has a wheeled housing with a laterally accessible compaction chamber wherein a vertically movable pressure plate is carried on a plurality of inflatable bladders which are suspended from the ceiling of the chamber. A gas bottle carried underneath the chamber bottom is connectable via a control valve to these bladders so as to expand them, pushing the pressure plate downwardly to compress loose trash in the compaction chamber. A plurality of cables connected to the corners of the pressure plate pass upwardly into a control compartment where they are led about rollers carried on piston rods of pneumatic cylinders also connectable by the valve to the gas bottle so as to allow these pistons to pull the pressure plate into an upper position at the top of the compaction chamber.

6 Claims, 4 Drawing Figures

TRASH COMPACTOR

FIELD OF THE INVENTION

My present invention relates to a trash compactor.

BACKGROUND OF THE INVENTION

Trash compactors are known which reduce bulk trash and garbage to a relatively compact mass. Such devices facilitate transportation, storage and disposal of what would normally be a relatively large volume of trash and garbage.

In the most common type of compactor an electric motor is used which serves to depress a heavy-duty ram in a compaction chamber designed to receive uncompacted trash. Such systems have the disadvantage that they are relatively bulky and require permanent installation near a convenient source of electric power.

OBJECTS OF THE INVENTION

It is therefore an object of my present invention to provide an improved trash compactor not dependent on an external power supply.

Another object of the invention is to provide a trash compactor which is highly mobile and which can be readily adapted for use in various facilities such as snack bars, dining cars, airplanes, ships or the like in which guests are served with disposable dishes and cutlery.

SUMMARY OF THE INVENTION

A trash compactor according to my invention, whose housing defines a compaction chamber having access means for the introduction of uncompacted trash, is provided with one or more inflatable bladders normally occupying a minor part of that chamber, the bladder or bladders being expandable against an accumulation of uncompacted trash in the chamber with the aid of valve-controlled fluid-pressure means preferably comprising a container of gas (e.g. air) under pressure. The bladder or bladders may be supported from above, on the fixed ceiling of the chamber, and may be fastened to a pressure plate which is thus movably suspended from the ceiling. The plate is advantageously connected through flexible link means, such as one or more cables or cords, to fluidic retraction means located above the ceiling within the housing, preferably a pair of antiparallel horizontal cylinders whose piston rods carry respective rollers engaged by the cord or cords. A control valve, or combination of valves, serves to connect the gas container alternately to the bladder or bladders and to the retraction cylinder or cylinders so as to keep the pressure plate either depressed or elevated. It is also advantageous to equip the conduit system with flow-limiting means in series with the retraction cylinder or cylinders for the purpose of preferentially discharging the container into the bladder or bladders, thereby insuring that the final operation carried out with the last residue of high-pressure gas in invariably a compaction stroke.

The housing of such a compactor may be provided with a wheeled base enabling same to be used as a serving and collecting trolley on passenger flights, on a train or in a luncheonette, for example.

BRIEF DESCRIPTION OF THE DRAWING

The above and other features of my invention will become more readily apparent from the following detailed description, reference being made to the accompanying drawing in which.

SPECIFIC DESCRIPTION

Figure 1:
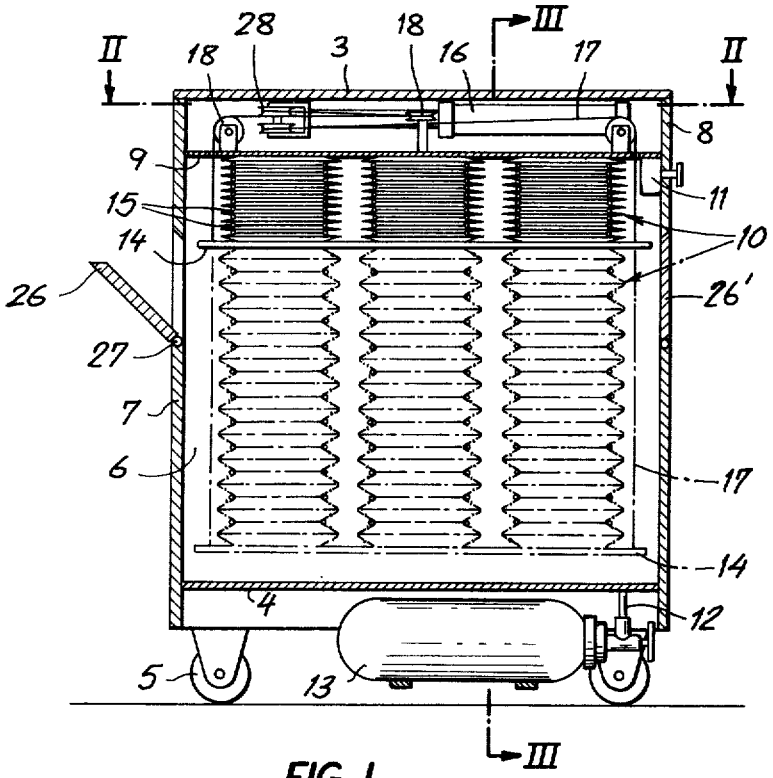
FIG. 1 is a longitudinal vertical section of a trash compactor according to the present invention.

The apparatus according to the present invention has a prismatic housing with a pair of opposite sidewalls 1 and 2 overlain by a flat top which may be used as a serving table. A bottom 4 of the housing defines with a ceiling 9 a compaction chamber 6 bonded by detachable end walls 7 and 8 whose removal facilitates emptying of the chamber. Wall 7 has a flap 26, hinged at 27, allowing trash to be deposited within the chamber 6, a similar flap 26' being provided in wall 8.

Ceiling 9, fixedly disposed below the top 3, supports three generally cylindrical bags or bladders 10 which carry at their lower ends a pressure plate 14 that is displaceable between an elevated position (solid lines, FIG. 1) and a depressed position indicated in dot-dash lines.

The bottom or base 4 of the apparatus has a downwardly open channel forming a central seat 19 in which a compressed-air bottle 13 is secured by brackets 24, this seat being flanked by a pair of liquid-collecting troughs 21. A grating 20 overlies the collecting troughs 21 and prevents the solids in the chamber from being pressed into same. This base structure gives the apparatus considerable rigidity with light weight. Wheels 5 are provided on the base 4 so as to permit the entire apparatus to be rolled along the floor or on the ground.

Figure 2:
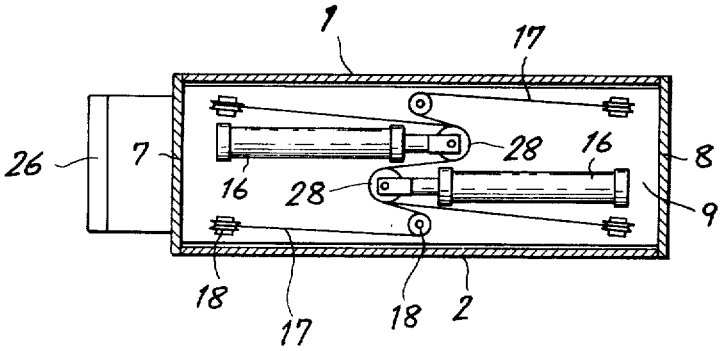
FIGS. 2 and 3 are sections taken along lines II—II and III—III, respectively, of FIG. 1.
Figure 3:
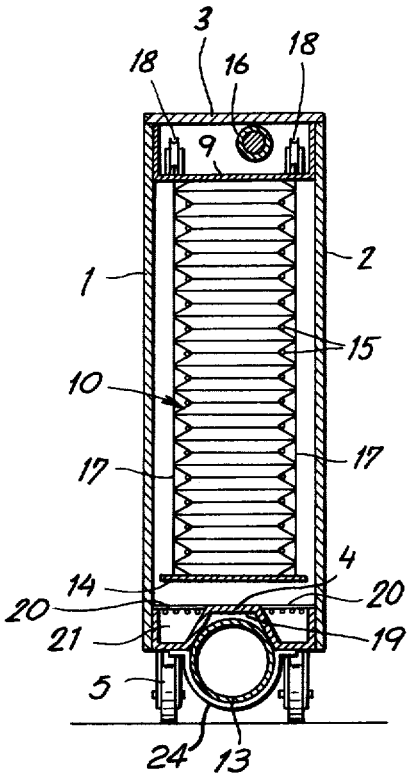

Two cables 17 have their ends connected to the four corners of the pressure plate 14 and extend upwardly through the ceiling 9 into a control compartment where they pass around fixedly positioned guide rollers 18 as well as two pairs of shiftable rollers 28, the latter being carried on the ends of two piston rods projecting from two single-acting hydraulic cylinders 16. Admission of pressure fluid into these cylinders displaces their pistons in opposite directions, from the position illustrated in FIG. 2, to lengthen the cable loops about rollers 28 so as to elevate the plate 14 which in the piston position of FIG. 2 is near its lowest point.

Figure 4:
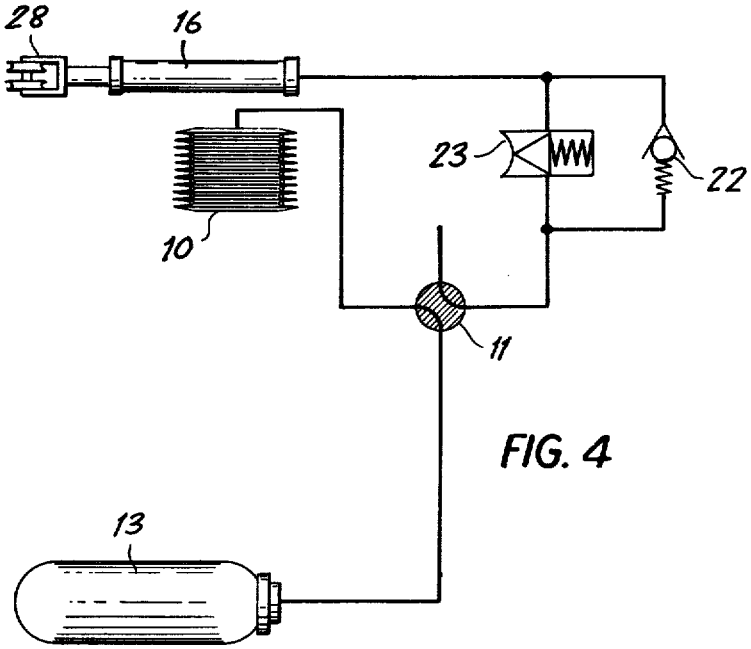
FIG. 4 is a schematic view illustrating a pneumatic control system for the apparatus shown in FIGS. 1 - 3.

As shown in FIGS. 1 and 4, the bottle 13 is connected through high-pressure lines to a four-way control valve 11 carried on the end wall 8 of the housing. This valve 11 is displaceable between a working position and a retracting position. In its working position, illustrated in FIG. 4, it pressurizes the bladders 10 and simultaneously vents the cylinders 16 to the atmosphere; this causes the plate 14 to descend and compact any loose trash present in the chamber 6.

In its retracted position the valve 11 pressurizes the cylinders 16 and vents the bladders 10 to the atmosphere. A check valve 22 and a threshold valve 23 lie in parallel with each other between the manually operable control valve 11 and the cylinders 16. Valve 23, loaded under a higher spring force than valve 22, leaves a minimum gas pressure available in bottle 13 for a final compaction stroke; check valve 22 insures the retention of enough gas in cylinders 16 to keep the cords 17 tensioned.

The bags or bladders 10 are generally cylindrical and are provided with peripheral accordion pleats occupied by a multiplicity of parallel, nonextensible metal rings 15 which limit their radial dilation.

I claim:

1. A trash compactor comprising:

a housing defining a compaction chamber provided with a ceiling and with access means for the introduction of uncompacted trash;

inflatable bladder means normally occupying a minor part of said chamber and bearing from below upon said ceiling;

a pressure plate in said chamber separated from said ceiling by said bladder means;

fluidic retraction means for said pressure plate above said ceiling;

flexible link means connecting said pressure plate to said retraction means;

a compressed-gas container carried on said housing; and valve-controlled conduit means for alternately connecting said container to said bladder means and to said retraction means, expansion of said bladder means by gas pressure from said container forcing said pressure plate onto an accummulation of loose trash in said chamber for compacting same.

2. The compactor defined in claim 1 wherein said retraction means comprises a pair of antiparallel horizontal cylinders with piston rods carrying respective rollers, said link means including at least one cord wound about said rollers and tied to said pressure plate at opposite edges thereof.

3. The compactor defined in claim 1 wherein said conduit means is provided with flow-limiting means in series with said retraction means for preferentially discharging said container into said bladder means.

4. The compactor defined in claim 1 wherein said housing is provided with a wheeled base, said container being mounted on said base.

5. The compactor defined in claim 1 wherein said housing is generally prismatic and provided with a pair of detachable end walls for emptying said chamber, said access means including a flap on one of said end walls.

6. The compactor defined in claim 1 wherein said bladder means comprises at least one generally cylindrical bag formed with peripheral accordion pleats and provided with a multiplicity of substantially inextensible reinforcing rings in said pleats limiting radial expansion of said bag.

* * * * *